United States Patent [19]

Bippus

[11] 4,154,375

[45] May 15, 1979

[54] PERSONAL CARE SPRAYER

[75] Inventor: Jacob R. Bippus, Pittsburgh, Pa.

[73] Assignee: Rockwell International Corporation, Pittsburgh, Pa.

[21] Appl. No.: 837,576

[22] Filed: Sep. 28, 1977

[51] Int. Cl.[2] ..... B67D 5/44; H01H 1/20

[52] U.S. Cl. ..... 222/325; 222/333; 222/383; 239/332; 200/61.86

[58] Field of Search ..... 222/333, 325, 380, 383, 222/400.5, 402; 239/332, 349; 200/61.86, 83 Q; 417/316, 317

[56] References Cited

U.S. PATENT DOCUMENTS

| | | | |
|---|---|---|---|
| 2,540,420 | 2/1951 | Bordelon | 200/61.86 |
| 3,565,344 | 2/1971 | Takei et al. | 239/332 |
| 3,993,250 | 11/1976 | Shure | 222/383 X |
| 4,033,511 | 7/1977 | Chamberlin | 222/383 X |

*Primary Examiner*—Joseph J. Rolla
*Assistant Examiner*—Edward M. Wacyra

[57] ABSTRACT

A rechargeable, battery-powered sprayer for personal products using a replaceable product-filled cartridge. The finger-operated control simultaneously opens the valve, allowing flow of material, and actuates the motor for pumping the material.

4 Claims, 3 Drawing Figures

PERSONAL CARE SPRAYER

BACKGROUND OF THE INVENTION

In the past, personal care products such as hair spray, deodorant, and the like were packaged using aerosal propellant. These convenient sprays, however, have been determined to pose a possible hazard to the human race, and are being phased out. One substitute much in vogue is a "pump"-type sprayer, in which the operator depresses the spray nozzle and an attached pump mechanism. It can be seen that the force of the spray in this instance would be governed by the operator and the duration by the pump structure. These will vary from individual to individual, and the duration in any event would be limited by the pump. However, this device eliminates the need for factory pressurization.

The present invention is designed to produce a continuous spray from a replaceable reservoir for as long as desired, followed by a positive shut-off to avoid leakage or spilling. This is accomplished without the need for prepressurization of the reservoir, by utilizing a pump connected to an electric motor which is powered by a rechargeable battery. The shut-off is effected by the use of an axial-moving valve member which is spring biased to the off position, positioned adjacent the spray nozzle to avoid leakage if the device is accidentally knocked over, or inadvertently laid on its side. An extension of the valve member is used to actuate the electric motor, so that the pump can only operate when the valve is open.

It is a principal purpose of this invention to provide a sprayer for dispensing personal care products without the necessity for using aerosols or the like propellants.

It is another purpose of this invention to provide a sprayer which will produce a continuous flow of product without the necessity of a pumping action on the part of the user.

It is a further purpose of this invention to provide a sprayer with a replaceable reservoir.

It is yet another important purpose of this invention to provide a sprayer with a single control for the valve controlling discharge of fluid and the motor used in pumping the fluid.

DESCRIPTION OF THE PREFERRED EMBODIMENT

Figure 1:
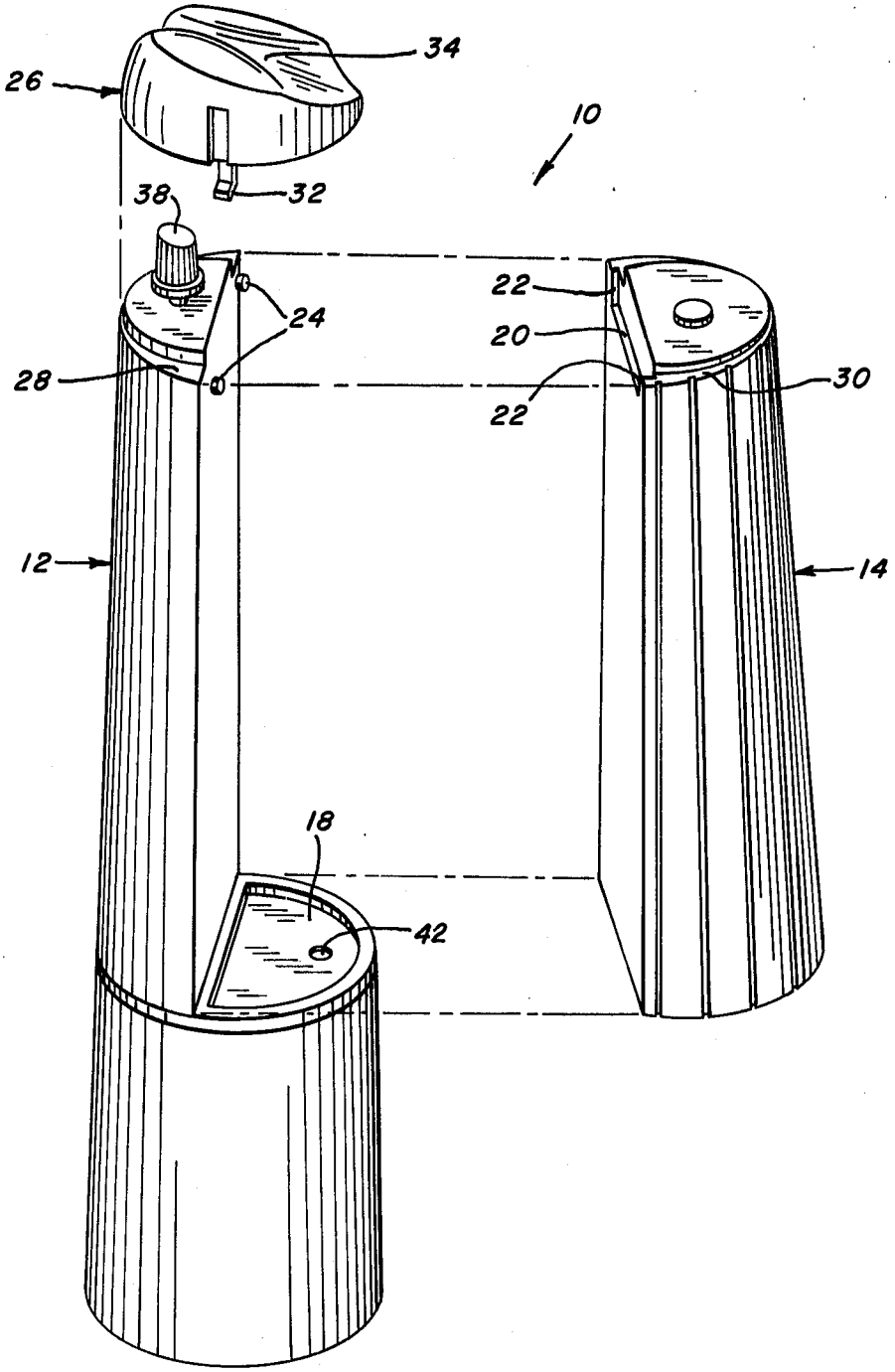
FIG. 1 is an exploded perspective view of the invention.

FIG. 1 shows the sprayer 10, illustrating the separable portions. Body 12 includes the operating mechanism and nozzle, which will be described later. Container 14 is the replaceable reservoir, which fits on body 12 by a projection on the under side 16 (see FIG. 2) nesting into recess 18 of body 12. At the top of container 14 is a ledge 20 having vertical walls 22. Walls 22 are dimensioned to engage the outer sides of pins 24 which project from body 12, thus positioning container 14 on body 12. A cap 26 is designed to snugly fit down over body 12 and container 14, seating on ledges 28 and 30, respectively, thus retaining body 12 and container 14 in assembled relation. Hooks 32 (only one shown in FIG. 1) fasten under pins 24, retaining cap 26 in place atop body 12 and container 14. Cap 26 is shaped with a finger-receiving groove 34 and an opening 36 (see FIG. 2) for a spray nozzle 38.

Figure 2:
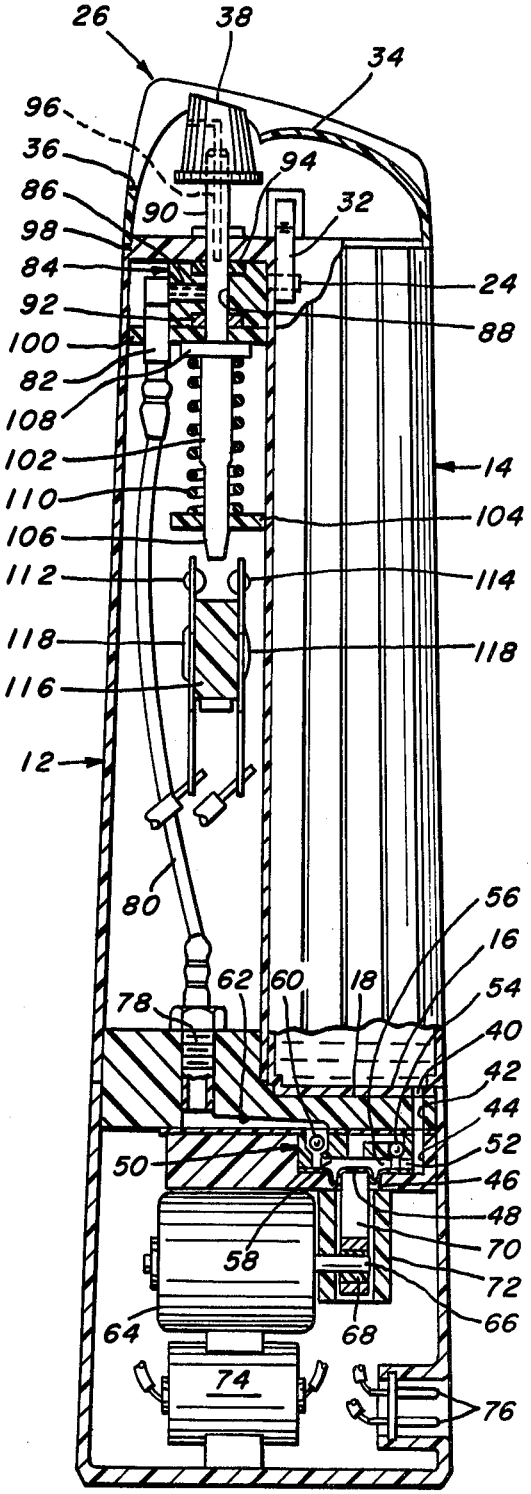
FIG. 2 is a side view, mostly in section, showing the pumping mechanism, fluid conduits, and controls; and, FIG. 3 is a front view, partially in section, and with the recharging receptacle displaced 180 degrees.
Figure 3:
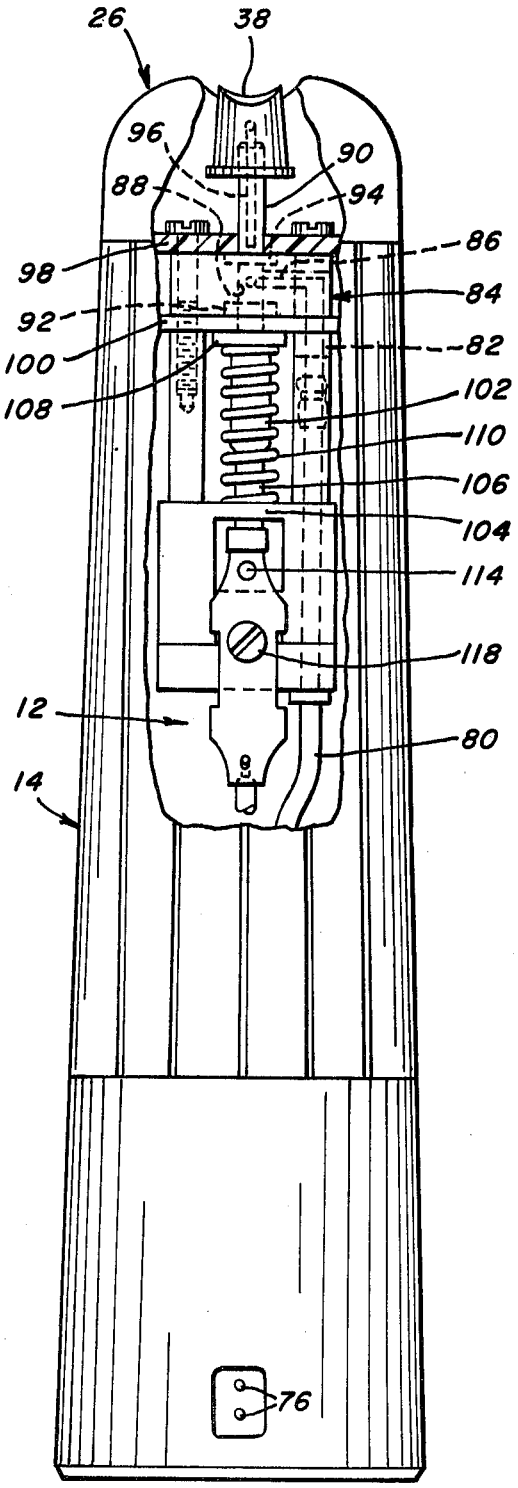

Referring now principally to FIGS. 2 and 3, it will be seen that container 14 is connected to body 12 by openings 40 and 42, respectively. It is envisioned that any of a number of known couplings can be utilized here to provide transfer of fluid. Opening 42 connects to a chamber 44, which has a bottom opening 46 covered by a flexible diaphragm 48. The diaphragm is retained in place by a block 50, which has an inlet channel 52 and an inlet ball check valve 54 and a connecting channel 56 from the inlet valve 54 to a pumping chamber 58. The outlet from pumping chamber 58 mounts an outlet ball check valve 60, leading to a passage 62 in body 12.

Under the diaphragm 48, a small, battery-powered electric motor 64 is mounted in the base of sprayer body 12. On the armature shaft 66, an eccentric cam 68 is fixed to rotate with the shaft. Between diaphragm 48 and cam 68 is a piston 70 freely reciprocable in a guide 72 molded integrally with body 12. When motor 64 is energized, rotation of cam 68 reciprocates piston 70, alternately reducing and expanding the volume of chamber 58, moving fluid through the chamber by the action of check valves 54 and 60.

The power for motor 64 preferably comes from a rechargeable battery source 74. These battery-motor combinations are widely used in hand-held power tools, garden sprayers and the like. They are widely available from vendors and usually include the means for recharging the batteries. Accordingly, they have merely been indicated here, with the contacts 76 being shown, where the recharging cord (or fixture, not shown) may be connected.

Also the wiring—except for the energizing contact for operating the sprayer, which will be described later—has merely been indicated, and not completely shown, as they are so well-known as not to be needed for an understanding of this invention.

The passage 62, which receives the discharge from pump chamber 58, is fitted with a tubing connector 78. Tubing 80 connects this connector 78 with another tubing connector 82, mounted in the head 84 of body 12. Tubing 80 is resilient and dampens the fluid surges from the reciprocating pump for a "smooth" spray. Connector 82 is in communication with a cross passage 86 in head 84 which connects with bore 88 which receives valve 90. Valve 90 is movable axially in head 84. The bore 88 is delimited by seal members 92 and 94 to control the discharge of fluid. Valve member 90 has an axial bore 96 from the top part-way down the valve member. A radial bore at the bottom of axial bore 96 enables communication with bore 88 when the valve is moved to the "on" position. As shown in FIGS. 2 and 3, the valve 90 is in the "off" position. When depressed downwardly by finger pressure on nozzle 38, the radial bore at the bottom of axial bore 96 is moved to a position below seal member 94, and fluid communication is thus established through connector 78, tubing 80, connector 82, passage 86, bore 88, axial bore 96, and nozzle 38, to atmosphere. Nozzle 38 is a conventional, widely-used mechanical breakup type aerosol actuator with a right angle passage therethrough for passage of liquid and a larger concentric bore in the bottom for seating the nozzle atop valve member 90.

Valve member 90 is guided for axial movement by projecting ledges molded integrally with sprayer body 12. Ledge 98 and ledge 100 also have provision for the seal rings 94 and 92, respectively. Valve member 90 also has an axially extending portion 102 which projects through ledge 104. The lower portion of valve 90 is of a reduced size, as at 106, and the end is flattened and tapered toward the end. This end portion is electrically conductive, for a purpose to be explained. Portion 102 carries a flange 108, which serves as an upper limit stop for valve 90, by abutment with ledge 100. It also is one seat for a coil spring 110, which biases valve 90 to the off position. Spring 110 is seated on its other end on ledge 104.

When it is desired to spray with this sprayer, and the valve 90 is depressed to the open position, the electrically conductive end portion 106 is simultaneously brought into engagement with electric contacts 112 and 114. These contacts are connected in the circuit between the rechargeable battery 74 and electric motor 64, and when end 106 makes contact, the motor starts, operating the piston diaphragm pump. Contacts 112 and 114 are fixed on a boss 116, which is integral with sprayer body 12, by a suitable means such as screws 118.

Thus, it will be seen that the depressing of nozzle 38 moves valve member 90 to the valve opened position and simultaneously activates motor 64 (and piston 70) to deliver a spray of fluid. Conversely, release of nozzle 38 allows spring 110 to move valve 90 to the "off" position and simultaneously interrupts the circuit to the motor.

I claim:

1. A portable fluid sprayer comprising, a pump, a motor adapted to drive said pump, conduit means interconnecting a replaceable reservoir to said pump and leading to a discharge opening, said conduit means having a spring-biased normally closed control valve assembly operatively disposed between said pump and said discharge opening and movable between valve-open and valve-closed positions, said valve assembly including an integral extension having electrically conductive contact means for completing an electrical circuit between a source of power and said motor when said valve is in the valve-open position, and disconnecting said circuit when said valve is in the valve-closed position, said valve assembly including stop means for limiting travel between the valve-open and valve-closed positions.

2. A portable fluid sprayer comprising, a replaceable reservoir containing a supply of fluid, a diaphragm-type piston pump with a pump inlet interconnected with said reservoir, an electric motor-driven cam means for operating said piston pump, ball check valves for controlling fluid inlet to and outlet from said pump, connecting conduit means from a pump outlet to a discharge valve chamber, a spring-biased normally closed control valve assembly adapted to be selectively opened for discharge of said fluid, said valve assembly including an integral electrically conductive plunger means for simultaneously completing an electrical circuit in order to energize said electric motor and open said discharge valve means.

3. The portable sprayer of claim 2 in which said discharge valve assembly is linearly movable between valve-closed and valve-opened positions, said valve assembly including stop means for limiting the travel of said valve assembly.

4. A portable fluid sprayer comprising a frame means, a motor operated pump and a replaceable reservoir mounted on said frame, conduit means interconnecting said reservoir, said pump and a discharge opening, said conduit means having a control valve assembly including an operating plunger operatively positioned between said pump and said discharge opening and movable between valve-open and valve-closed positions, the operating plunger of said valve assembly having an integral electrically conductive extension for completing an electric circuit to said motor-operated pump when said valve is in the valve-open position, and said electric circuit being interrupted when said control valve is in the valve-closed position, said control valve assembly including stop means for limiting the travel of said plunger.

* * * * *